US009581149B2

(12) United States Patent
Ota et al.

(10) Patent No.: US 9,581,149 B2
(45) Date of Patent: Feb. 28, 2017

(54) DOUBLE-HEADED PISTON TYPE SWASH PLATE COMPRESSOR

(71) Applicant: KABUSHIKI KAISHA TOYOTA JIDOSHOKKI, Aichi-ken (JP)

(72) Inventors: Masaki Ota, Kariya (JP); Shinya Yamamoto, Kariya (JP); Takahiro Suzuki, Kariya (JP); Kei Nishii, Kariya (JP); Yusuke Yamazaki, Kariya (JP); Kazunari Honda, Kariya (JP)

(73) Assignee: KABUSHIKI KAISHA TOYOTA JIDOSHOKKI, Aichi-Ken (JP)

( * ) Notice: Subject to any disclaimer, the term of this patent is extended or adjusted under 35 U.S.C. 154(b) by 456 days.

(21) Appl. No.: 14/301,661

(22) Filed: Jun. 11, 2014

(65) Prior Publication Data

US 2014/0369862 A1 Dec. 18, 2014

(30) Foreign Application Priority Data

Jun. 13, 2013 (JP) ..... 2013-124735

(51) Int. Cl.
*F04B 27/12* (2006.01)
*F04B 1/29* (2006.01)
*F04B 27/18* (2006.01)

(52) U.S. Cl.
CPC ..... *F04B 27/1804* (2013.01); *F04B 1/295* (2013.01); *F04B 27/12* (2013.01);
(Continued)

(58) Field of Classification Search
CPC ..... F04B 27/12; F04B 2027/1831; F04B 2027/1859; F04B 2027/1813; F04B 1/146;
(Continued)

(56) References Cited

U.S. PATENT DOCUMENTS 4,932,843 A 6/1990 Itoigawa et al.
5,002,466 A * 3/1991 Inagaki ..... F04B 27/1072 417/222.1

(Continued)

FOREIGN PATENT DOCUMENTS

JP 01-190972 8/1989

*Primary Examiner* — Bryan Lettman
*Assistant Examiner* — Timothy Solak
(74) *Attorney, Agent, or Firm* — Greenblum & Bernstein, P.L.C.

(57) ABSTRACT

A double-headed piston type swash plate compressor includes a swash plate, a double-headed piston, a control pressure chamber, a discharge pressure region, a suction pressure region, a supplying passage, which extends from the discharge pressure region to the control pressure chamber, a narrowing portion, which narrows an opening degree of the supplying passage, and a displacement control valve. The displacement control valve controls a pressure in the control pressure chamber. The displacement control valve includes a driving force transmission rod, a valve chamber, a guide wall, and a back pressure chamber. The back pressure chamber is in communication with the valve chamber through a clearance between the guide wall and the driving force transmission rod. The narrowing portion has a passage cross-sectional area that is larger than a passage cross-sectional area of the clearance.

2 Claims, 4 Drawing Sheets

(52) U.S. Cl.
CPC ..... *F04B 2027/1809* (2013.01); *F04B 2027/1813* (2013.01); *F04B 2027/1831* (2013.01); *F04B 2027/1859* (2013.01)

(58) Field of Classification Search
CPC .... F04B 1/16; F04B 1/28; F04B 1/295; F04B 27/0813; F04B 27/10; F04B 27/18; F04B 2027/1818; F04B 2027/185; F04B 27/08; F04B 27/0804; F04B 27/0808; F04B 27/0821; F04B 27/086; F04B 27/14; F04B 27/16; F04B 2027/1809; F04B 2027/1822; F04B 2027/1827; F04B 2027/1836; F04B 1/14; F04B 1/26
See application file for complete search history.

(56) References Cited

U.S. PATENT DOCUMENTS

2006/0165534 A1* 7/2006 Umemura ..... F04B 27/1804 417/222.2
2008/0240928 A1* 10/2008 Wang ..... F04B 27/1018 417/26

* cited by examiner

DOUBLE-HEADED PISTON TYPE SWASH PLATE COMPRESSOR

BACKGROUND OF THE INVENTION

The present invention relates to a double-headed piston type swash plate compressor including a double-headed piston that engages with a swash plate and reciprocates with a stroke according to an inclination angle of the swash plate.

Japanese Laid-open Patent Publication H1-190972 teaches one example of a double-headed piston type swash plate compressor having a crank chamber. The crank chamber in this publication does not function as a control pressure chamber for varying an inclination angle of a swash plate. This differs from a variable displacement type swash plate compressor including a single-headed piston in which a crank chamber functions as a control pressure chamber. For this reason, the double-headed piston type swash plate compressor has a movable body that is connected with the swash plate to vary the inclination angle of the swash plate. The movable body moves in an axial direction of a rotation shaft when a control pressure chamber formed in a housing is supplied with a control gas to change a pressure inside the control pressure chamber. The movement of the movable body in the axial direction of the rotation shaft changes the inclination angle of the swash plate. The double-headed piston type swash plate compressor further includes a displacement control valve for controlling a pressure in the control pressure chamber.

The control pressure chamber defines a smaller space than the crank chamber. Accordingly, the response characteristic of the displacement control valve for controlling the pressure in the control pressure chamber is likely to affect the variability of the inclination angle of the swash plate. It is desirable that the response characteristic of the displacement control valve be improved.

SUMMARY OF THE INVENTION

The objective of the present invention is to provide a double-headed piston type swash plate compressor that improves the response characteristic of a displacement control valve.

To achieve the foregoing objective, a double-headed piston type swash plate compressor according to one aspect of the present invention includes a housing, a rotation shaft, a swash plate, a crank chamber, a double-headed piston, a movable body, a control pressure chamber, a discharge pressure region, a suction pressure region, a supplying passage, a narrowing portion, an exhaust passage, and a displacement control valve. The swash plate is rotated by a driving force of the rotation shaft. The swash plate is configured to vary an inclination angle with respect to the rotation shaft. The crank chamber is formed in the housing and accommodates the swash plate. The double-headed piston engages with the swash plate. The double-headed piston reciprocates with a stroke according to the inclination angle of the swash plate. The movable body is connected with the swash plate to vary the inclination angle of the swash plate. The control pressure chamber is arranged in the housing and defined by the movable body. The control pressure chamber is configured to move the movable body in an axial direction of the rotation shaft when the control pressure chamber is supplied with a control gas to change a pressure inside the control pressure chamber. The supplying passage extends from the discharge pressure region to the control pressure chamber. The narrowing portion narrows an opening degree of the supplying passage. The exhaust passage extends from the control pressure chamber to the suction pressure region. The displacement control valve controls a pressure in the control pressure chamber. The displacement control valve includes an electromagnetic solenoid, a part of the exhaust passage, a driving force transmission rod, a valve chamber, a pressure sensing chamber, a pressure sensing mechanism, a guide wall, a back pressure chamber, and a communication passage. The driving force transmission rod includes a valve body that adjusts an opening degree of the exhaust passage. The driving force transmission rod is driven by the electromagnetic solenoid. The valve chamber accommodates the valve body. The pressure sensing chamber is in communication with the suction pressure region. The pressure sensing mechanism is accommodated in the pressure sensing chamber. The pressure sensing mechanism is configured to expand and contract along a movement direction of the driving force transmission rod in accordance with a pressure in the suction pressure region so as to adjust an opening degree of the valve body. The guide wall guides the driving force transmission rod to move along the movement direction. The back pressure chamber is arranged between the electromagnetic solenoid and the valve chamber. The back pressure chamber is in communication with the valve chamber through a clearance between the guide wall and the driving force transmission rod. The back pressure chamber communicates with the pressure sensing chamber through the communication passage. The narrowing portion has a passage cross-sectional area that is larger than a passage cross-sectional area of the clearance.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Hereafter, discussion will be made on one embodiment that embodies the present invention according to FIGS. 1 to 4.

Figure 1:
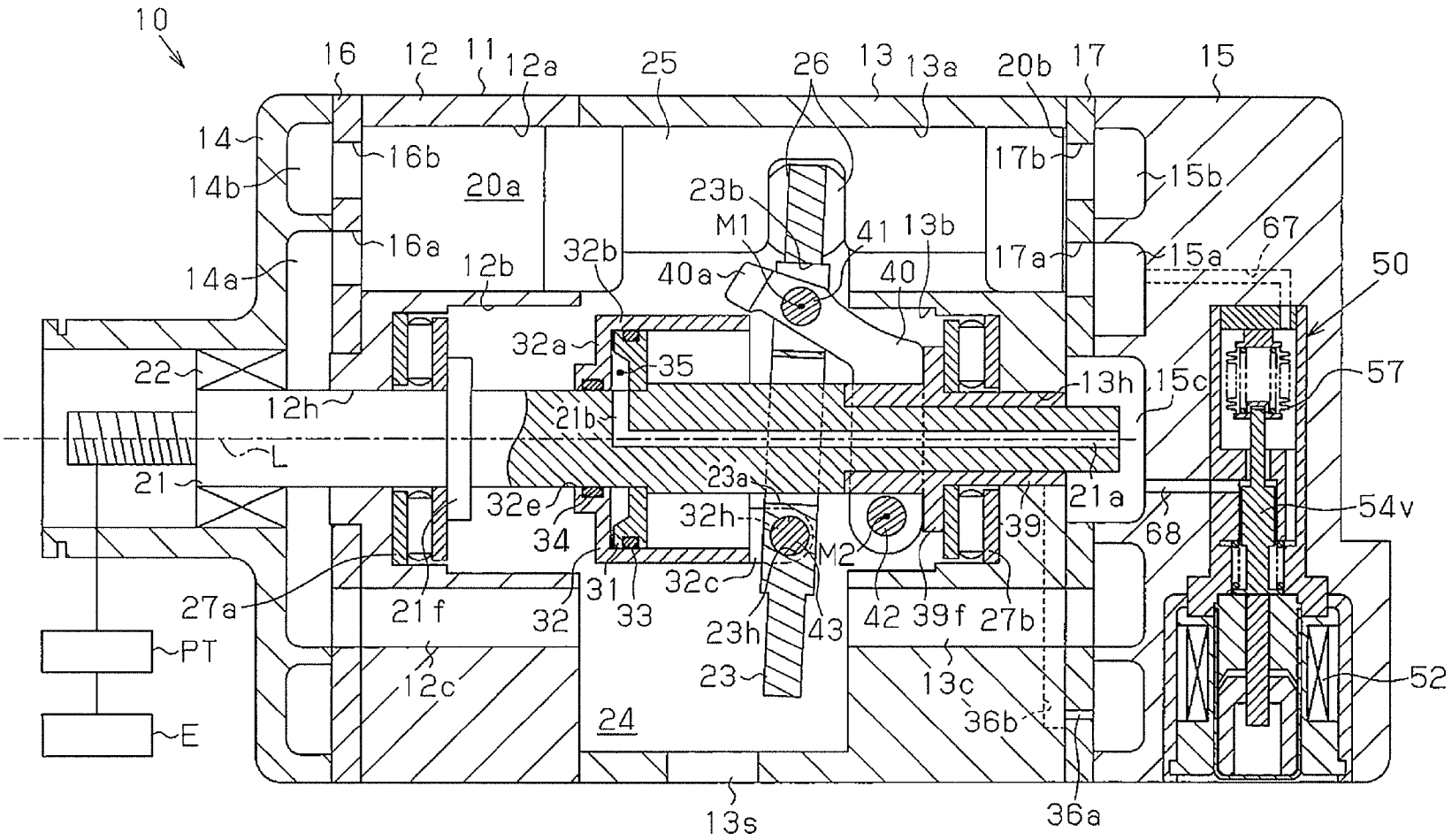
FIG. 1 is a side cross-sectional view showing a double-headed piston type swash plate compressor according to one embodiment of the present invention.

As shown in FIG. 1, a housing 11 of a double-headed piston type swash plate compressor 10 includes a first cylinder block 12 and a second cylinder block 13 connected to each other. The double-headed piston type swash plate compressor 10 further includes a front housing 14, which is connected with the first cylinder block 12 located toward a front (one side) and a rear housing 15, which is connected with the second cylinder block 13 located toward a rear (the other side).

A first valve/port formation body 16 is disposed between the front housing 14 and the first cylinder block 12. A second valve/port formation body 17 is disposed between the rear housing 15 and the second cylinder block 13.

A suction chamber 14*a* and a discharge chamber 14*b* are defined between the front housing 14 and the first valve/port formation body 16. The discharge chamber 14*b* is arranged radially outside the suction chamber 14*a*. A suction chamber 15*a* and a discharge chamber 15*b* are defined between the rear housing 15 and the second valve/port formation body 17. A pressure adjustment chamber 15*c* is arranged in the rear housing 15. The pressure adjustment chamber 15*c* is arranged at a central portion of the rear housing 15. The suction chamber 15*a* is arranged radially outside the pressure adjustment chamber 15*c*. The discharge chamber 15*b* is arranged radially outside the suction chamber 15*a*. The discharge chambers 14*b* and 15*b* are in communication with each other through a discharge passage, which is not shown. The discharge passage is connected with an outer refrigerant circuit, which is not shown. The discharge chambers 14*b* and 15*b* serve as a discharge pressure region.

The first valve/port formation body 16 is formed with a suction port 16*a*, which is in communication with the suction chamber 14*a* and a discharge port 16*b*, which is in communication with the discharge chamber 14*b*. The second valve/port formation body 17 is formed with a suction port 17*a*, which is in communication with the suction chamber 15*a* and a discharge port 17*b*, which is in communication with the discharge chamber 15*b*. A suction valve mechanism, which is not shown, is arranged in each of the suction ports 16*a* and 17*a*. A discharge valve mechanism, which is not shown, is arranged in each of the discharge ports 16*b* and 17*b*.

A rotation shaft 21 is supported in the housing 11 to be rotatable. A front end portion of the rotation shaft 21 is inserted into a shaft hole 12*h*, which extends through the first cylinder block 12. The front end portion of the rotation shaft 21 is a portion of the rotation shaft 21 closer to a first end of the rotation shaft 21 in a direction along which a central axis L extends (i.e., an axial direction of the rotation shaft 21). The front end portion of the rotation shaft 21 is located toward a front side (one side) of the housing 11. A front end of the rotation shaft 21 is arranged inside the front housing 14. A rear end portion of the rotation shaft 21 is inserted into a shaft hole 13*h*, which extends through the second cylinder block 13. The rear end portion of the rotation shaft 21 is a portion of the rotation shaft 21 closer to a second end of the rotation shaft 21 in the direction along which the central axis L extends (i.e., the axial direction of the rotation shaft 21). The rear end portion of the rotation shaft 21 is located toward a rear side (the other side) of the housing 11. A rear end of the rotation shaft 21 is arranged inside the pressure adjustment chamber 15*c*.

The front end portion of the rotation shaft 21 is supported to be rotatable by the first cylinder block 12 through the shaft hole 12*h*. The rear end portion of the rotation shaft 21 is supported to be rotatable by the second cylinder block 13 through the shaft hole 13*h*. A shaft seal device 22 of a lip seal type is disposed between the front housing 14 and the rotation shaft 21. The front end of the rotation shaft 21 operably connects with a vehicle engine E, which serves as an external driving source through a driving force transmission mechanism PT. In the present embodiment, the driving force transmission mechanism PT is a clutch-less mechanism (for example, a combination of a belt and a pulley), which is an always transmitting type.

A crank chamber 24 is arranged in the housing 11 and defined by the first cylinder block 12 and the second cylinder block 13. The crank chamber 24 accommodates a swash plate 23, which is rotated by a driving force of the rotation shaft 21 and is inclined with respect to the rotation shaft 21 in the axial direction. The swash plate 23 is formed with an insertion hole 23*a* into which the rotation shaft 21 is inserted. The rotation shaft 21 is inserted into the insertion hole 23*a* so that the rotation shaft 21 connects with the swash plate 23.

The first cylinder block 12 is formed with a plurality of first cylinder bores 12*a*, which are arranged around the rotation shaft 21. FIG. 1 shows one of the first cylinder bores 12*a*. Each of the first cylinder bores 12*a* extends through the first cylinder block 12 in the axial direction. Each of the first cylinder bores 12*a* is in communication with the suction chamber 14*a* through the suction port 16*a* and is in communication with the discharge chamber 14*b* through the discharge port 16*b*. The second cylinder block 13 is formed with a plurality of second cylinder bores 13*a*, which are arranged around the rotation shaft 21. FIG. 1 shows one of the second cylinder bores 13*a*. Each of the second cylinder bores 13*a* extends through the second cylinder block 13 in the axial direction. Each of the second cylinder bores 13*a* is in communication with the suction chamber 15*a* through the suction port 17*a* and is in communication with the discharge chamber 15*b* through the discharge port 17*b*. The first cylinder bores 12*a* and the second cylinder bores 13*a* are arranged at the front and the rear to form respective pairs. A double-headed piston 25 is accommodated in each cylinder bore including the first cylinder bore 12*a* and the second cylinder bore 13*a* to be reciprocable in a front and rear direction.

Each double-headed piston 25 engages with a radially outer portion of the swash plate 23 through a pair of shoes 26. Rotational movement of the swash plate 23 by the rotation of the rotation shaft 21 is converted to a reciprocable linear movement of the double-headed piston 25 through the shoes 26. The double-headed piston 25 and the first valve/port formation body 16 define a first compression chamber 20*a* in each first cylinder bore 12*a*. The double-headed piston 25 and the second valve/port formation body 17 define a second compression chamber 20*b* in each second cylinder bore 13*a*.

The first cylinder block 12 is formed with a first large diameter hole 12*b*, which is continuous with the shaft hole 12*h* and has a larger diameter than the shaft hole 12*h*. The first large diameter hole 12*b* is in communication with the crank chamber 24. The crank chamber 24 is in communication with the suction chamber 14*a* through a suction passage 12*c*, which extends through the first cylinder block 12 and the first valve/port formation body 16.

The second cylinder block 13 is formed with a second large diameter hole 13*b*, which is continuous with the shaft hole 13*h* and has a larger diameter than the shaft hole 13*h*. The second large diameter hole 13*b* is in communication with the crank chamber 24. The crank chamber 24 is in communication with the suction chamber 15*a* through a suction passage 13*c*, which extends through the second cylinder block 13 and the second valve/port formation body 17.

The second cylinder block 13 has a peripheral wall that is formed with a suction port 13*s*. The suction port 13*s* is connected with the outer refrigerant circuit. Refrigerant gas drawn into the crank chamber 24 through the suction port 13*s* from the outer refrigerant circuit is drawn into the suction chambers 14*a* and 15*a* through the suction passages 12*c* and 13*c*. The suction chambers 14*a* and 15*a* and the crank chamber 24 serve as a suction pressure region and have pressures substantially the same to each other.

The rotation shaft 21 has a flange portion 21*f* that projects from the rotation shaft 21 and is arranged in the first large diameter hole 12*b*. A first thrust bearing 27*a* is disposed between the flange portion 21*f* and the first cylinder block 12 in the axial direction of the rotation shaft 21. A support member 39 having a circular tube shape is press-fitted to the rear end portion of the rotation shaft 21. The support member 39 has a radially outer surface having a circular flange portion 39*f* that projects from the radially outer surface and is arranged in the second large diameter hole 13*b*. A second thrust bearing 27*b* is disposed between the flange portion 39*f* and the second cylinder block 13 in the axial direction of the rotation shaft 21.

A fixed body 31 having a circular ring shape is fixed to a portion of the rotation shaft 21 located between the rear side of the flange portion 21*f* and the front side of the swash plate 23. The fixed body 31 is rotatable integrally with the rotation shaft 21. A movable body 32 is arranged between the flange portion 21*f* and the fixed body 31. The movable body 32 has a circular tube shape having a bottom. The movable body 32 is movable with respect to the fixed body 31 in the axial direction of the rotation shaft 21.

The movable body 32 includes a bottom portion 32*a*, which is formed to be a circular ring shape having an insertion hole 32*e* to which the rotation shaft 21 is inserted and a circular tube portion 32*b*, which extends from a radially outer edge of the bottom portion 32*a* in the axial direction of the rotation shaft 21. A radially inner surface of the circular tube portion 32*b* contacts with a radially outer edge of the fixed body 31 in a slidable manner. The movable body 32 is rotatable integrally with the rotation shaft 21 through the fixed body 31. A seal member 33 is arranged between the radially inner surface of the circular tube portion 32*b* and the radially outer edge of the fixed body 31 to seal therebetween. A seal member 34 is arranged between the insertion hole 32*e* and the rotation shaft 21 to seal therebetween. The fixed body 31 and the movable body 32 define a control pressure chamber 35 therebetween.

The rotation shaft 21 includes a first internal passage 21*a* that is arranged inside the rotation shaft 21 and extends in the axial direction of the rotation shaft 21. A rear end of the first internal passage 21*a* opens toward the pressure adjustment chamber 15*c*. The rotation shaft 21 further includes a second internal passage 21*b* that is arranged inside the rotation shaft 21 and extends in a radial direction of the rotation shaft 21. The second internal passage 21*b* has a first end, which is in communication with a distal end of the first internal passage 21*a* and a second end, which opens toward the control pressure chamber 35. The control pressure chamber 35 is in communication with the pressure adjustment chamber 15*c* through the first internal passage 21*a* and the second internal passage 21*b*.

A lug arm 40 is disposed between the swash plate 23 and the flange portion 39*f* in the crank chamber 24. The lug arm 40 shaped to be a substantially L-shaped, has a first end and a second end. A weighted portion 40*a* is arranged in the first end of the lug arm 40. The lug arm 40 extends through a groove 23*b* so that the weighted portion 40*a* is arranged in front of the swash plate 23.

A first pin 41 extends through the groove 23*b* transversely. The first pin 41 connects a portion of the lug arm 40 that is closer to the first end of the lug arm 40 with a portion of the swash plate 23 that is closer to an upper end of the swash plate 23 (an upper portion in FIG. 1). The swash plate 23 supports the portion of the lug arm 40 that is closer to the first end of the lug arm 40 to be swingable about an axis of the first pin 41. The axis of the first pin 41 serves as a first swing center M1. A second pin 42 connects a portion of the lug arm 40 that is closer to the second end of the lug arm 40 with the support member 39. The support member 39 supports the portion of the lug arm 40 that is closer to the second end of the lug arm 40 to be swingable about an axis of the second pin 42. The axis of the second pin 42 serves as a second swing center M2.

A distal end of the circular tube portion 32*b* of the movable body 32 has a connecting portion 32*c* that projects toward the swash plate 23. The connecting portion 32*c* is formed with a movable body side insertion hole 32*h* into which a third pin 43 is inserted. A portion of the swash plate 23 closer to an lower end of the swash plate 23 (a lower portion in FIG. 1) is formed with a swash plate side insertion hole 23*h* into which the third pin 43 is inserted. The third pin 43 connects the connecting portion 32*c* with the portion of the swash plate 23 closer to the lower end of the swash plate 23.

The second valve/port formation body 17 is formed with a narrowing portion 36*a*. The narrowing portion 36*a* extends through the second valve/port formation body 17 and is in communication with the discharge chamber 15*b*. An end face of the second cylinder block 13 closer to the second valve/port formation body 17 is formed with a communication portion 36*b* that depresses from the end face of the second cylinder block 13 and communicates the pressure adjustment chamber 15*c* with the narrowing portion 36*a*. The discharge chamber 15*b* is in communication with the control pressure chamber 35 through the narrowing portion 36*a*, the communication portion 36*b*, the pressure adjustment chamber 15*c*, the first internal passage 21*a* and the second internal passage 21*b*. Accordingly, the narrowing portion 36*a*, the communication portion 36*b*, the pressure adjustment chamber 15*c*, the first internal passage 21*a* and the second internal passage 21*b* serve as a supplying passage that extends from the discharge chamber 15*b* to the control pressure chamber 35. The narrowing portion 36*a* narrows an opening degree of the supplying passage. A displacement control valve 50 of an electromagnetic type is arranged in the rear housing 15 to control a pressure in the control pressure chamber 35. The displacement control valve 50 communicatively connects electrically with a control computer, which is not shown.

Figure 2:
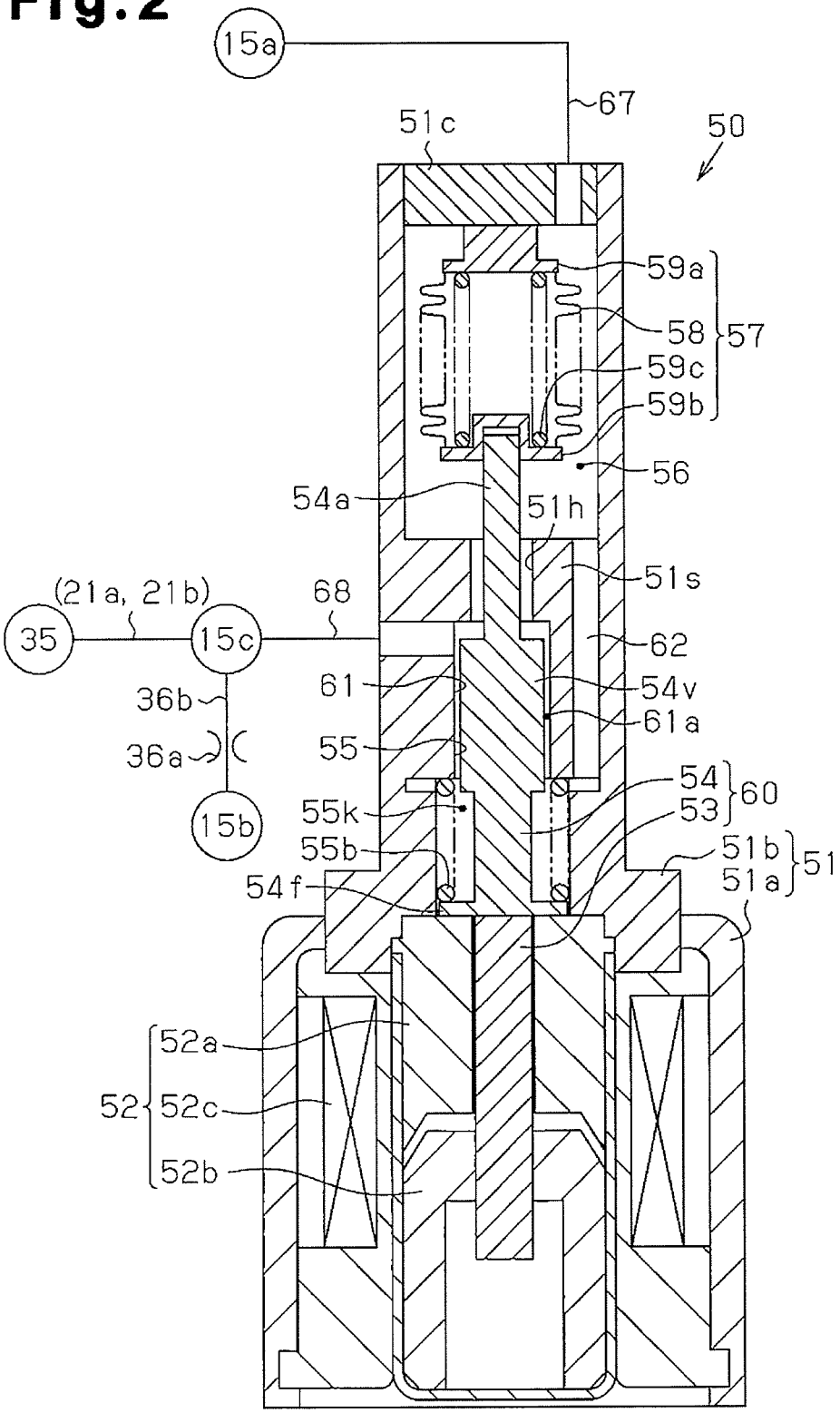
FIG. 2 is a cross-sectional view of a displacement control valve of FIG. 1 when an inclination angle of a swash plate is at a minimum.
Figure 3:
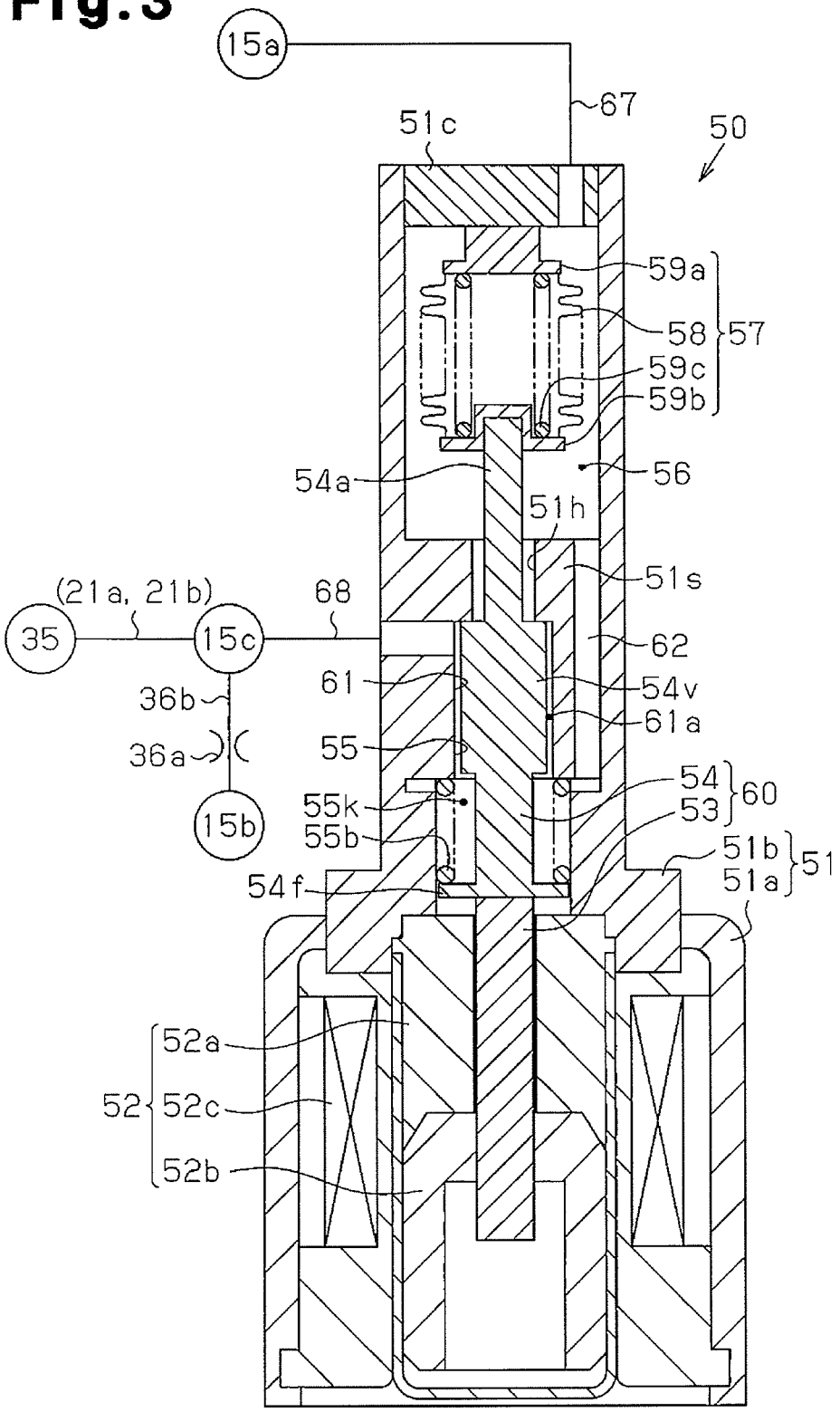
FIG. 3 is a cross-sectional view of a displacement control valve of FIG. 1 when an inclination angle of a swash plate is at a maximum.

As shown in FIG. 2, a valve housing 51 of the displacement control valve 50 includes a first housing 51*a*, which accommodates an electromagnetic solenoid 52, a second housing 51*b*, which has a tube shape and is attached to the first housing 51*a*, and a lid portion 51*c*, which has a plate shape and is located at a portion of the valve housing 51 opposite to the first housing 51*a* to close an opening of the second housing 51*b*. A dividing wall 51*s* is arranged in the second housing 51*b*. The dividing wall 51*s* divides an internal space of the second housing 51*b* into a valve chamber 55 and a pressure sensing chamber 56.

The electromagnetic solenoid 52 includes a fixed iron core 52*a* and a movable iron core 52*b*. A coil 52*c* is supplied with a current and is excited so that the movable iron core 52*b* is attracted to the fixed iron core 52*a*. The control computer controls the current to be supplied to the electromagnetic solenoid 52 (a duty ratio control).

A driving force transmission member 53 having a circular column shape is attached to the movable iron core 52*b* so that the driving force transmission member 53 is movable integrally with the movable iron core 52*b*. A back pressure chamber 55*k* is formed between the electromagnetic solenoid 52 and the valve chamber 55. The driving force transmission member 53 extends from an inside of the first housing 51*a* to the back pressure chamber 55*k*. A valve body formation member 54 having a circular column shape is arranged in the valve chamber 55 and the back pressure chamber 55*k*. The valve body formation member 54 includes a valve body 54*v*, which is accommodated in the valve chamber 55. The valve body 54*v* has an outer diameter that is greater than a shaft diameter of the valve body formation member 54.

A projecting portion 54*a* having a circular column shape is arranged on an end surface of the valve body 54*v* that is closer to the pressure sensing chamber 56. The projecting portion 54*a* extends through a valve hole 51*h* of the dividing wall 51*s* and projects into the pressure sensing chamber 56. A flange portion 54*f* having a circular ring shape is arranged in and projected from an end portion of the valve body formation member 54 that is located closer to the driving force transmission member 53. A biasing spring 55*b* is disposed in the back pressure chamber 55*k* and biases the flange portion 54*f* toward the driving force transmission member 53.

The valve body 54*v* come into and out of contact with the dividing wall 51*s* to open and close the valve hole 51*h*. An electromagnetic force of the electromagnetic solenoid 52 biases the valve body 54*v* against a spring force of the biasing spring 55*b* toward a position at which the valve body 54*v* closes the valve hole 51*h*. The driving force transmission member 53 and the valve body formation member 54 serve as a driving force transmission rod 60 that is driven by the electromagnetic solenoid 52. The electromagnetic solenoid 52, the back pressure chamber 55*k*, the valve chamber 55 and the pressure sensing chamber 56 are arranged in this order along an axial direction of the driving force transmission rod 60. A guide wall 61 having a circular tube shape guides the driving force transmission rod 60 in the valve chamber 50 along a movement direction of the driving force transmission rod 60.

The valve body formation member 54 (valve body 54*v*) is formed of a material (for example, aluminum), which is lighter than the driving force transmission member 53 in weight. The valve body formation member 54 (valve body 54*v*) has a surface that is subjected to a surface treatment such as a coating so as to have an excellent wear resistance.

The pressure sensing chamber 56 accommodates a pressure sensing mechanism 57. The pressure sensing mechanism 57 includes a bellows 58, a pressure receiving body 59*a*, which connects with an end portion of the bellows 58 that is closer to the lid portion 51*c*, a connection body 59*b*, which connects with an end portion of the bellows 58 that is closer to the projecting portion 54*a*, and a spring 59*c*, which is disposed in the bellows 58 to bias the pressure receiving body 59*a* and the connection body 59*b* in a direction to separate to each other. The projecting portion 54*a* has an end portion closer to the connection body 59*b* that connects with the connection body 59*b* in a manner as to come into and out of contact with the connection body 59*b*.

The pressure sensing chamber 56 is in communication with the suction chamber 15*a* through a passage 67. The valve chamber 55 is in communication with the pressure adjustment chamber 15*c* through a passage 68. Accordingly, the second internal passage 21*b*, the first internal passage 21*a*, the pressure adjustment chamber 15*c*, the passage 68, the valve chamber 55, the valve hole 51*h*, the pressure sensing chamber 56 and the passage 67 serve as an exhaust passage that extends from the control pressure chamber 35 to the suction chamber 15*a*.

The bellows 58 expands and contracts in the movement direction of the driving force transmission rod 60 in accordance with a pressure in the pressure sensing chamber 56. Specifically, the bellows 58 is configured to expand and contract when the bellows sensed a pressure in the suction chamber 15*a* that acts on an end surface of the connection body 59*b* that is closer to the projecting portion 54*a*. The expansion and contraction of the bellows 58 is used for determining the position of the valve body 54*v*. This contributes to the adjustment for a valve opening degree by the valve body 54*v*. The valve opening degree of the valve body 54*v* is determined by a balance of the electromagnetic force generated in the electromagnetic solenoid 52, the biasing force of the biasing spring 55*b*, and the biasing force of the pressure sensing mechanism 57.

The valve body 54*v* adjusts the opening degree (passage cross-sectional area) of the exhaust passage. The valve body 54*v* closes the exhaust passage when contacting with the dividing wall 51*s*. The valve body 54*v* opens the exhaust passage when separating from the dividing wall 51*s*.

The pressure in the control pressure chamber 35 is adjusted by introducing the refrigerant gas from the discharge chamber 15*b* to the control pressure chamber 35 through the narrowing portion 36*a*, the communication portion 36*b*, the pressure adjustment chamber 15*c*, the first internal passage 21*a* and the second internal passage 21*b*, and by exhausting the refrigerant gas from the control pressure chamber 35 to the suction chamber 15*a* through the second internal passage 21*b*, the first internal passage 21*a*, the pressure adjustment chamber 15*c*, the passage 68, the valve chamber 55, the valve hole 51*h*, the pressure sensing chamber 56 and the passage 67. Accordingly, the refrigerant gas introduced to the control pressure chamber 35 serves as a control gas that adjusts the pressure in the control pressure chamber 35. The movable body 32 moves with respect to the fixed body 31 along the axial direction of the rotation shaft 21 in accordance with a pressure difference between the control pressure chamber 35 and the crank chamber 24.

In the double-headed piston type swash plate compressor 10 configured as discussed above, as shown in FIG. 3, when reducing the valve opening degree of the valve body 54*v*, a flow amount of the refrigerant gas exhausted from the control pressure chamber 35 to the suction chamber 15*a* through the second internal passage 21*b*, the first internal passage 21*a*, the pressure adjustment chamber 15*c*, the passage 68, the valve chamber 55, the valve hole 51*h*, the pressure sensing chamber 56, and the passage 67 is reduced. The refrigerant gas is introduced from the discharge chamber 15*b* to the control pressure chamber 35 through the narrowing portion 36*a*, the communication portion 36*b*, the pressure adjustment chamber 15*c*, the first internal passage 21*a* and the second internal passage 21*b*. The pressure in the control pressure chamber 35 becomes generally the same as the pressure in the discharge chamber 15*b*.

Figure 4:
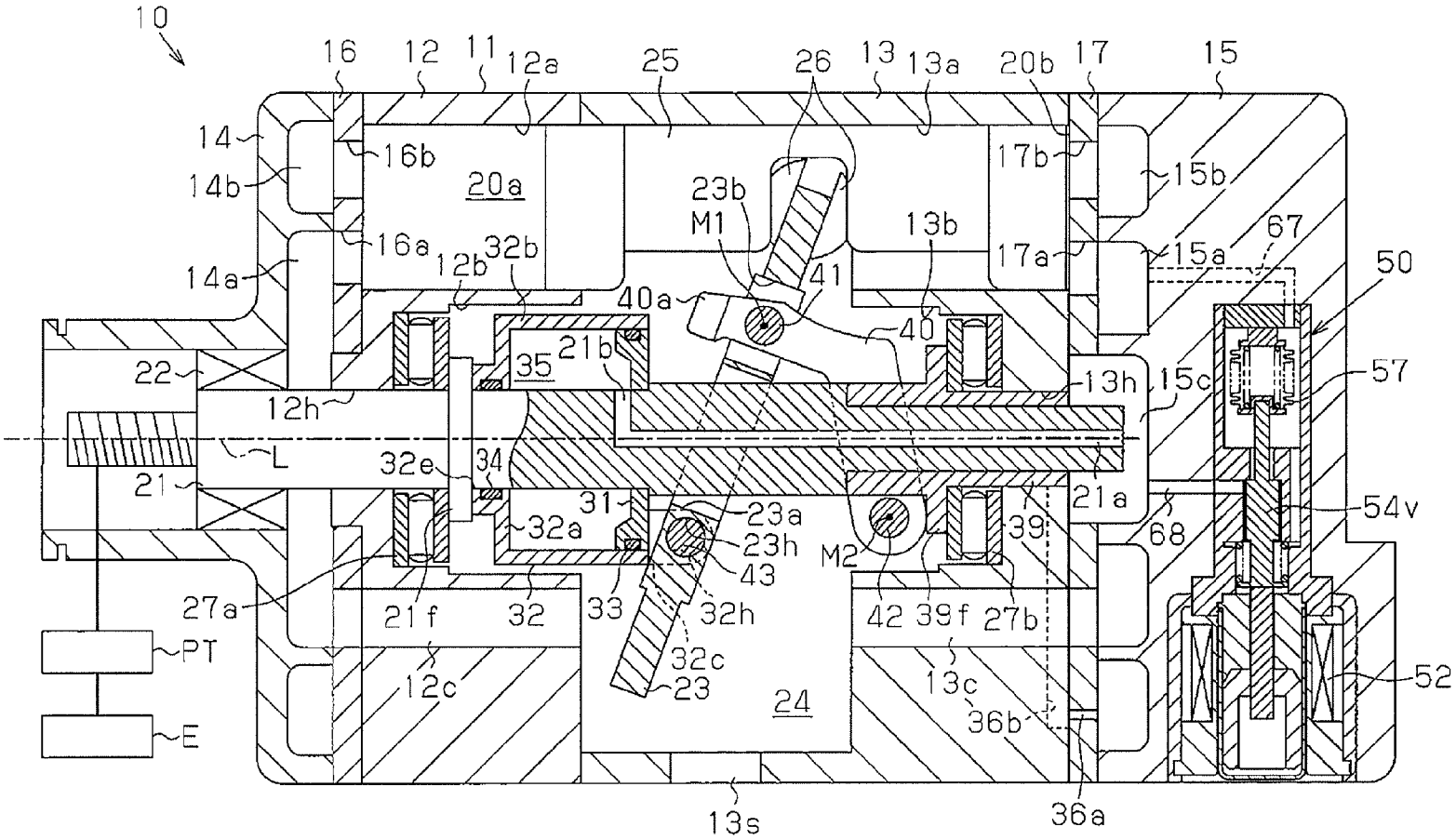
FIG. 4 is a side cross-sectional view showing a double-headed piston type swash plate compressor of FIG. 1 when an inclination angle of a swash plate is at a maximum.

As shown in FIG. 4, when the pressure difference between the control pressure chamber 35 and the crank chamber 24 becomes larger, the movable body 32 moves to separate the bottom portion 32*a* of the movable body 32 from the fixed body 31 . This enables the swash plate 23 to swing about the first swing center M1. This swing movement of the swash plate 23 enables the two ends of the lug arm 40 to swing about the first swing center M1 and the second swing center M2, respectively so that the lug arm 40 separates from the flange portion 39*f* of the support member 39. This increases the inclination angle of the swash plate 23 and increases the stroke of the double-headed piston 25 so as to increase the discharge displacement. The movable body 32 contacts with the flange portion 21*f* when the inclination angle of the swash plate 23 reaches a maximum inclination angle θ max. The contact between the movable body 32 and the flange portion 21*f* maintains the inclination angle of the swash plate 23 at the maximum inclination angle θ max.

As shown in FIG. 2, when increasing the valve opening degree of the valve body 54*v*, the flow amount of the refrigerant gas exhausted from the control pressure chamber 35 to the suction chamber 15*a* through the second internal passage 21*b*, the first internal passage 21*a*, the pressure adjustment chamber 15*c*, the passage 68, the valve chamber 55, the valve hole 51*h*, the pressure sensing chamber 56, and the passage 67 is increased. The pressure in the control pressure chamber 35 becomes generally the same as the pressure in the suction chamber 15*a*.

As shown in FIG. 1, when the pressure difference between the control pressure chamber 35 and the crank chamber 24 becomes smaller, the movable body 32 moves so that the bottom portion 32*a* of the movable body 32 approaches the fixed body 31. This enables the swash plate 23 to swing about the first swing center M1 in a direction opposed to a swing direction when increasing the inclination angle of the swash plate 23. This swing movement of the swash plate 23 enables the two ends of the lug arm 40 swing about the first swing center M1 and the second swing center M2, respectively in the direction opposed to a swing direction when increasing the inclination angle of the swash plate 23 so that the lug arm 40 approaches the flange portion 39*f* of the support member 39. This reduces the inclination angle of the swash plate 23 and reduces the stroke of the double-headed piston 25 so as to reduce the discharge displacement. The lug arm 40 contacts with the flange portion 39*f* of the support member 39 when the inclination angle of the swash plate 23 reaches a minimum inclination angle θ min. The contact between the lug arm 40 and the flange portion 39*f* maintains the inclination angle of the swash plate 23 at the minimum inclination angle θ min.

As shown in FIG. 2, a clearance 61*a* is defined between the guide wall 61 and the driving force transmission rod 60. The back pressure chamber 55*k* is in communication with the valve chamber 55 through the clearance 61*a*. The narrowing portion 36*a* has a passage cross-sectional area that is larger than a passage cross-sectional area of the clearance 61*a*. The second housing 51*b* is formed with a communication passage 62 through which the back pressure chamber 55*k* is in communication with the pressure sensing chamber 56.

Next, discussion will be made on the operation of the present embodiment.

The clearance 61*a* is formed between the guide wall 61 and the driving force transmission rod 60. The clearance 61*a* enables the driving force transmission rod 60 and the valve body 54*v* to move smoothly. In addition, the clearance 61*a* enables the refrigerant gas to flow from the control pressure chamber 35 to the back pressure chamber 55*k* through the clearance 61*a*. In the present embodiment, the narrowing portion 36*a* has the passage cross-sectional area that is larger than the passage cross-sectional area of the clearance 61*a*. This enables an amount of the refrigerant gas that flows to the back pressure chamber 55*k* through the clearance 61*a* to be smaller compared to a structure in which the narrowing portion 36*a* has the passage cross-sectional area that is smaller than the passage cross-sectional area of the clearance 61*a*. This eliminates the necessity to increase the amount of the refrigerant gas to be introduced from the discharge chamber 15*b* to the control pressure chamber 35 by an amount corresponding to the reduced amount of the refrigerant gas from the control pressure chamber 35 to the back pressure chamber 55*k* through the clearance 61*a*.

Further, the communication passage 62 enables the back pressure chamber 55*k* to communicate with the pressure sensing chamber 56 so that the pressure in the back pressure chamber 55*k* approaches the pressure in the suction chamber 15*a*. This prevents the pressure in the back pressure chamber 55*k* to be the same as the pressure in the control pressure chamber 35. This suppresses the effect on the valve opening degree of the valve body 54*v* that is adjusted by the pressure sensing mechanism 57.

The present embodiment has the advantages described below.

(1) The displacement control valve 50 includes the guide wall 61, the back pressure chamber 55*k*, and the communication passage 62. The guide wall 61 guides the driving force transmission rod 60 to move along the movement direction. The back pressure chamber 55*k* is arranged between the electromagnetic solenoid 52 and the valve chamber 55. The back pressure chamber 55*k* is in communication with the valve chamber 55 through the clearance 61*a* between the guide wall 61 and the driving force transmission rod 60. The back pressure chamber 55*k* communicates with the pressure sensing chamber 56 through the communication passage 62.

According to this configuration, the clearance 61*a* is formed between the guide wall 61 and the driving force transmission rod 60. The clearance 61*a* enables the driving force transmission rod 60 and the valve body 54*v* to move smoothly. In addition, the narrowing portion 36*a* has the passage cross-sectional area that is larger than the passage cross-sectional area of the clearance 61*a*. This enables an amount of the refrigerant gas that flows to the back pressure chamber 55*k* through the clearance 61*a* to be smaller compared to a structure in which the narrowing portion 36*a* has the passage cross-sectional area that is smaller than the passage cross-sectional area of the clearance 61*a*. This eliminates the necessity to increase the amount of the refrigerant gas to be introduced from the discharge chamber 15*b* to the control pressure chamber 35 by an amount corresponding to the reduced amount of the refrigerant gas from the control pressure chamber 35 to the back pressure chamber 55*k* through the clearance 61*a*. Further, the communication passage 62 enables the back pressure chamber 55*k* to communicate with the pressure sensing chamber 56 so that the pressure in the back pressure chamber 55*k* approaches the pressure in the suction chamber 15*a*. This prevents the pressure in the back pressure chamber 55*k* to be the same as the pressure in the control pressure chamber 35. This suppresses the effect on the valve opening degree of the valve body 54*v* that is adjusted by the pressure sensing mechanism 57. As a result, the present invention improves the response characteristic of the displacement control valve 50.

(2) The electromagnetic solenoid 52, the back pressure chamber 55*k*, the valve chamber 55 and the pressure sensing chamber 56 are arranged in this order along the axial direction of the driving force transmission rod 60. According to this configuration, the pressure sensing chamber 56 is arranged at an end portion of the driving force transmission rod 60 in the axial direction. This allows for the arrangement of the pressure sensing mechanism 57 to be easier compared to a structure in which the pressure sensing chamber 56 is arranged between the electromagnetic solenoid 52 and the valve chamber 55 in the axial direction. The present invention is preferable in manufacturability of the displacement control valve 50.

(3) The larger the diameter of the valve hole 51*h* is, the larger a flow amount of the refrigerant gas exhausted from the control pressure chamber 35 to the suction chamber 15*a* is. The present invention shorten the time necessary for the pressure in the control pressure chamber 35 to be generally the same as the pressure in the suction chamber 15*a*. However, enlargement of the diameter of the valve hole 51*h* requires an outer diameter of the valve body 54*v* that opens and closes the valve hole 51*h* to be larger. Enlargement of the outer diameter of the valve body 54*v* enlarges a passage cross-sectional are of the clearance 61*a*. This increases the amount of the refrigerant gas to flow from the control pressure chamber 35 to the back pressure chamber 55*k* through the clearance 61*a*. In the present embodiment, the narrowing portion 36*a* has the passage cross-sectional area that is larger than the passage cross-sectional area of the clearance 61*a*. This reduces an amount of the refrigerant gas that flows to the back pressure chamber 55*k* through the clearance 61*a*. This eliminates the necessity to increase the amount of the refrigerant gas to be introduced from the discharge chamber 15*b* to the control pressure chamber 35 by an amount corresponding to the reduced amount of the refrigerant gas from the control pressure chamber 35 to the back pressure chamber 55*k* through the clearance 61*a*.

(4) The valve body formation member 54 is formed of a material (for example, aluminum) lighter than the driving force transmission member 53 in weight. This suppresses the displacement control valve 50 to be heavier even when the size of the valve body 54*v* is larger.

(5) The valve body formation member 54 has a surface that is subjected to a surface treatment such as a coating having an excellent wear resistance. This suppresses the valve body 54*v* from eroded by a cavitation, which generates when the refrigerant gas flowing through between the valve body 54*v* and the dividing wall 51*s* includes a liquefied refrigerant.

(6) The biasing spring 55*b* is disposed in the back pressure chamber 55*k*. This facilitates to secure the cross-sectional area of magnetic path generated by the electromagnetic solenoid 52 compared to a structure in which the biasing spring 55*b* is disposed between the fixed iron core 52*a* and the movable iron core 52*b*.

It should be apparent to those skilled in the art that the present invention may be embodied in many other specific forms without departing from the spirit or scope of the invention. Particularly, it should be understood that the present invention may be embodied in the following forms.

In this embodiment, the pressure sensing chamber 56 may be arranged between the electromagnetic solenoid 52 and the valve chamber 55 in the axial direction of the driving force transmission rod 60.

In this embodiment, a supplying passage may be formed between the discharge chamber 14*b* and the control pressure chamber 35, for example. In other words, the supplying passage needs to be formed between the discharge pressure region and the control pressure chamber 35.

In this embodiment, an exhaust passage may be formed between the control pressure chamber 35 and the suction chamber 14*a*, for example. In other words, the exhaust passage needs to be formed between the control pressure chamber 35 and the suction pressure region.

In this embodiment, the valve body formation member 54 needs to be formed of a material that is lighter in weight than a material of the driving force transmission member 53. The valve body formation member 54 may be formed of a resin material, for example.

In this embodiment, the valve body formation member 54 may have a surface that is not subjected to a surface treatment such as a coating having an excellent wear resistance.

In this embodiment, the driving force transmission member 53 may be formed integral with the valve body formation member 54.

In this embodiment, the swash plate 23 may receive a driving force from the external driving source through a clutch.

What is claimed is:

1. A double-headed piston type swash plate compressor comprising:

a housing;

a rotation shaft;

a swash plate that is rotated by a driving force of the rotation shaft, wherein the swash plate is configured to vary an inclination angle with respect to the rotation shaft;

a crank chamber that is formed in the housing and accommodates the swash plate;

a double-headed piston that engages with the swash plate, wherein the double-headed piston reciprocates with a stroke according to the inclination angle of the swash plate;

a movable body that is connected with the swash plate to vary the inclination angle of the swash plate;

a control pressure chamber that is arranged in the housing and defined by the movable body, wherein the control pressure chamber is configured to move the movable body in an axial direction of the rotation shaft when the control pressure chamber is supplied with a control gas to change a pressure inside the control pressure chamber;

a discharge pressure region;

a suction pressure region;

a supplying passage that extends from the discharge pressure region to the control pressure chamber;

a narrowing portion that narrows an opening degree of the supplying passage;

an exhaust passage that extends from the control pressure chamber to the suction pressure region; and a displacement control valve that controls a pressure in the control pressure chamber, wherein the displacement control valve includes:

an electromagnetic solenoid;

a part of the exhaust passage;

a driving force transmission rod including a valve body that adjusts an opening degree of the exhaust passage, wherein the driving force transmission rod is driven by the electromagnetic solenoid;

a valve chamber that accommodates the valve body;

a pressure sensing chamber that is in communication with the suction pressure region;

a pressure sensing mechanism that is accommodated in the pressure sensing chamber, wherein the pressure sensing mechanism is configured to expand and contract along a movement direction of the driving force transmission rod in accordance with a pressure in the suction pressure region so as to adjust an opening degree of the valve body;

a guide wall that guides the driving force transmission rod to move along the movement direction;

a back pressure chamber that is arranged between the electromagnetic solenoid and the valve chamber, wherein the back pressure chamber is in communication with the valve chamber through a clearance between the guide wall and the driving force transmission rod; and a communication passage through which the back pressure chamber communicates with the pressure sensing chamber;

wherein the narrowing portion has a passage cross-sectional area that is larger than a passage cross-sectional area of the clearance.

2. The double-headed piston type swash plate compressor according to claim 1, wherein the electromagnetic solenoid, the back pressure chamber, the valve chamber and the pressure sensing chamber are arranged in this order along an axial direction of the driving force transmission rod.

* * * * *